US011864711B2

(12) United States Patent
Kretz et al.

(10) Patent No.: US 11,864,711 B2
(45) **Date of Patent: *Jan. 9, 2024**

(54) DISHWASHER HAVING A TERMINAL BOX

(71) Applicant: Whirlpool Corporation, Benton Harbor, MI (US)

(72) Inventors: Richard Lawrence Kretz, Findlay, OH (US); Harry Wayne Dickson, Fostoria, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 209 days.

This patent is subject to a terminal disclaimer.

(21) Appl. No.: 17/399,463

(22) Filed: Aug. 11, 2021

(65) Prior Publication Data

US 2021/0369078 A1 Dec. 2, 2021

Related U.S. Application Data

(63) Continuation of application No. 16/106,671, filed on Aug. 21, 2018, now Pat. No. 11,109,738.

(51) Int. Cl.
*A47L 15/42* (2006.01)

(52) U.S. Cl.
CPC ..... *A47L 15/4272* (2013.01); *A47L 15/4253* (2013.01); *A47L 15/4246* (2013.01); *A47L 15/4261* (2013.01)

(58) Field of Classification Search
CPC ..... A47L 15/4253
See application file for complete search history.

(56) References Cited

U.S. PATENT DOCUMENTS

| | | | |
|---|---|---|---|
| 8,486,202 | B2 | 7/2013 | Haltmayer et al. |
| 9,655,497 | B2 | 5/2017 | Lindgren et al. |
| 2018/0192849 | A1 | 7/2018 | O'Brien et al. |

FOREIGN PATENT DOCUMENTS

| | | | |
|---|---|---|---|
| CN | 107374550 | A | 11/2017 |
| CN | 107518854 | A | 12/2017 |

*Primary Examiner* — Jason Y Ko
(74) *Attorney, Agent, or Firm* — McGarry Bair PC

(57) ABSTRACT

A dishwasher having a tub at least partially defining a treating chamber has a chassis supporting the tub. The chassis has a base and defines a space below the tub, and a terminal box having at least one enclosure wall defining an interior is located within the space. A wire connection box is located within the interior of the terminal box. The wire connection box includes a housing and multiple terminals, and is configured to receive and couple the electrical connection for the dishwasher and the electrical mains power line.

20 Claims, 5 Drawing Sheets

DISHWASHER HAVING A TERMINAL BOX

CROSS-REFERENCE TO RELATED APPLICATIONS

This application is a continuation of and claims benefit to U.S. patent application Ser. No. 16/106,671, filed Aug. 21, 2018, now U.S. Pat. No. 11,109,738, issued Sep. 7, 2021, which is incorporated herein by reference in its entirety.

BACKGROUND

Contemporary automatic dishwashers for use in a home typically include a terminal box. Such terminal boxes may also be known as a junction box. The terminal box can be used for connecting the power line of the home to other electrical connections of the dishwasher such as the pump and controller. Both hot lines and ground lines can also run to the terminal box from both the power line and the other electrical connections of the dishwasher.

BRIEF DESCRIPTION

An aspect of the present disclosure relates to a dishwasher for treating dishes according to at least one automatic cycle of operation, the dishwasher comprising a tub at least partially defining a treating chamber, a chassis supporting the tub and defining a space below the tub, a terminal box located within the space and having at least one enclosure wall defining an interior, and a wire connection box located within the interior wherein the wire connection box includes a housing and multiple terminals inset within the housing and wherein the wire connection box is configured to receive an electrical connection for the dishwasher coupled to an electrical mains power line and wherein the housing is configured to keep wires from contacting the at least one enclosure wall of the terminal box.

Another aspect of the present disclosure relates to a dishwasher for treating dishes according to at least one automatic cycle of operation, the dishwasher comprising a tub at least partially defining a treating chamber, a chassis supporting the tub and defining a space underneath the tub, a terminal box located within the space and having a rear wall and an enclosure wall extending from the rear wall, together defining an interior, wherein the rear wall comprises a first opening configured to receive an electrical mains power line and wherein the enclosure wall comprises a second opening configured to receive a dishwasher electrical connection, and a wire connection box fastened to the rear wall of the terminal box and having a housing with multiple terminals electrically coupling the electrical mains power line and the dishwasher electrical connection, wherein the housing isolates the electrical mains power line and the dishwasher electrical connection from the rear wall and the enclosure wall of the terminal box.

DETAILED DESCRIPTION

Figure 1:
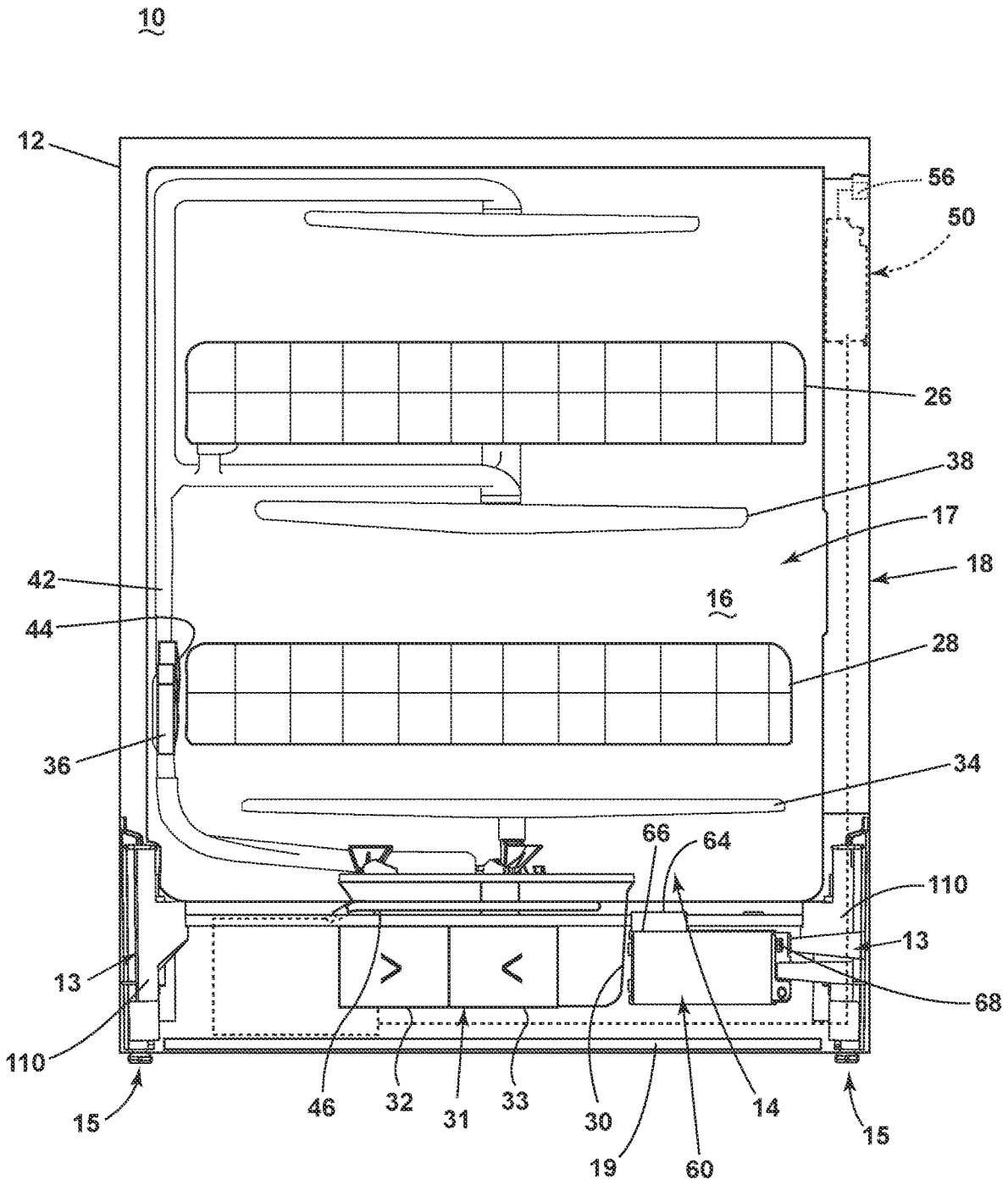
FIG. 1 is a schematic, cross-sectional view of a dishwasher according to an aspect of the present disclosure.

In FIG. 1, an automated dishwasher 10 according to aspects of the present disclosure is illustrated. The dishwasher 10 shares many features of a conventional automated dishwasher, which will not be described in detail herein except as necessary for a complete understanding. A chassis 12 can define an interior of the dishwasher 10 and can include a frame, with or without panels mounted to the frame. By way of non-limiting example, a base 13 can be included in the chassis 12. Further, leveling assemblies 15 can be included in each corner of the base 13 to help level the chassis 12.

An open-faced tub 14 can at least partially define a treating chamber 16, having an open face, for washing dishes. The chassis 12 can support the tub 14 and can collectively define a space below the tub 14. More specifically, in the illustrated example, the chassis 12 is illustrated as supporting the tub 14 and including two spaced footings or panels 110 with two spaced rails 120 suspended between the two spaced panels 110 and wherein the two spaced panels 110 and the rails 120 collectively define a space 17 below the tub 14. A drip tray 19 can be located in the space 17 below the tub 14. The drip tray 19 can be configured to retain any liquid that escapes from above.

A closure, or door assembly 18 can be movably mounted to the dishwasher 10 for movement between opened and closed positions to selectively open and close the open face of the tub 14. Thus, the door assembly provides accessibility to the treating chamber 16 for the loading and unloading of dishes or other treatable items. It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, an access opening 17 to the treating chamber 16 can be closed, whereas the access opening 17 to the treating chamber 16 can be open when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware. While the dishwasher 10 is shown with two dish racks, any number of dish racks can be included.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system can include a sump 30 and a pump assembly 31. The sump 30 collects the liquid sprayed in the treating chamber 16 and can be formed by a sloped or recess portion of a bottom wall of the tub 14. The pump assembly 31 can include both a drain pump 32 and a recirculation pump 33. The drain pump 32 can draw liquid from the sump 30 and pump the liquid out of the dishwasher 10 to a household drain line (not shown). The recirculation pump 33 can draw liquid from the sump 30 and the liquid can be simultaneously or selectively pumped through a supply tube 42 to each of the assemblies 34, 36, 38, 40 for selective spraying. While not shown, a liquid supply system can include a water supply conduit coupled with a household water supply for supplying water to the treating chamber 16.

A heating system including a heater 46 can be located within the sump 30 for heating the liquid contained in the sump 30.

A controller 50 can also be included in the dishwasher 10, which can be operably coupled with various components of the dishwasher 10 to implement a cycle of operation. The controller 50 can be located within the door 18 as illustrated, or it can alternatively be located somewhere within the chassis 12. The controller 50 can also be operably coupled with a control panel or user interface 56 for receiving user-selected inputs and communicating information to the user. The user interface 56 can include operational controls such as dials, lights, switches, and displays enabling a user to input commands, such as a cycle of operation, to the controller 50 and receive information.

Figure 4:
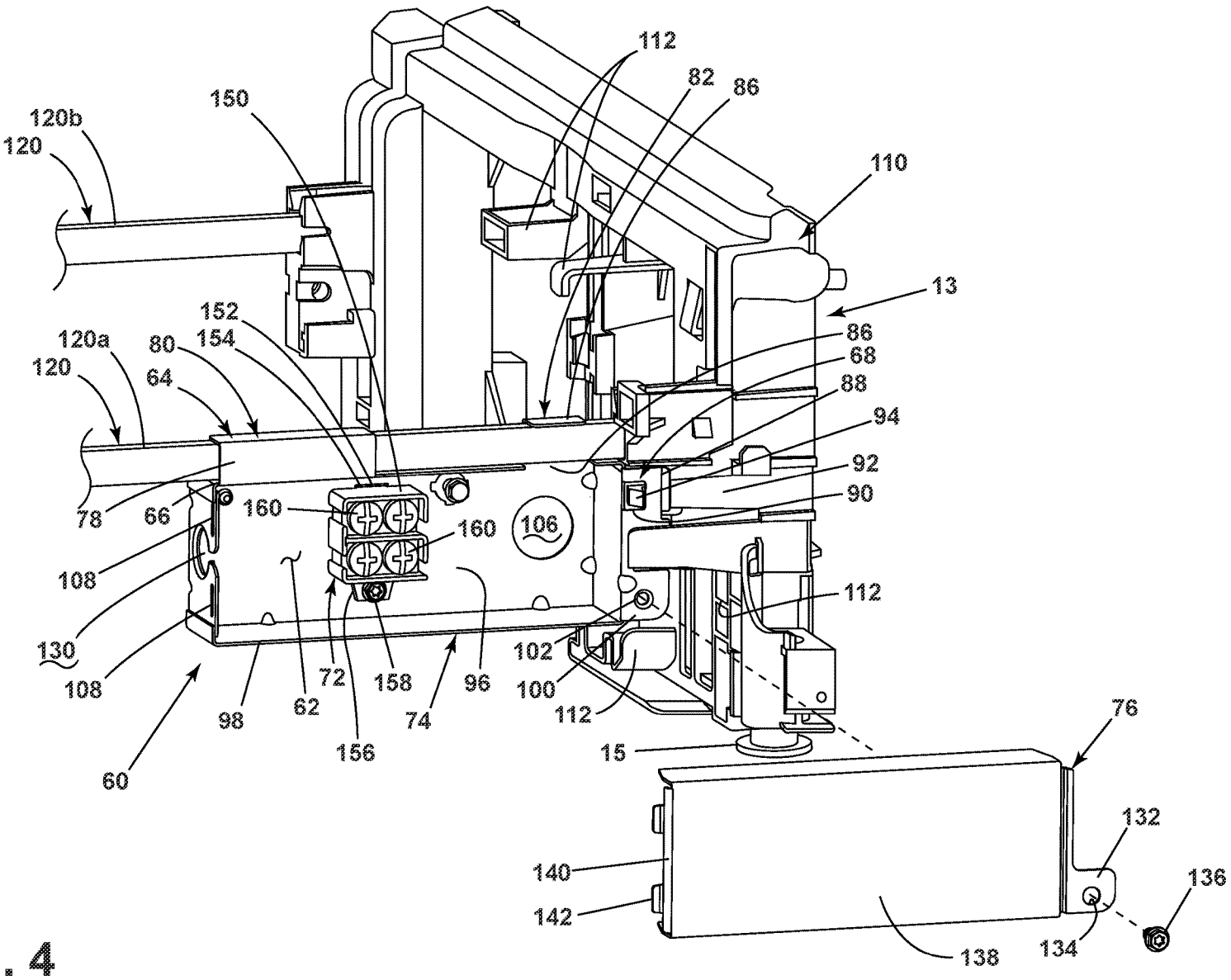
FIG. 4 is a perspective view of a portion of the chassis of FIG. 3 with a portion of the terminal box exploded for clarity.

A terminal box 60 can also be included in the dishwasher 10. The terminal box 60 defines an interior 62 (FIG. 4). The terminal box 60 can be located within the space 17 beneath the tub 14 and can be mounted to the chassis 12. A first hook 64 extends from an upper section 66 of the terminal box 60 and is configured to retain one of the rails 120. A fastener 68 operably couples the terminal box 60 to one of the two spaced panels 110.

The terminal box can be operably coupled between the controller 50 or any other electrical component such as, by way of non-exhaustive list, heater 46, the drain pump 32, and the recirculation pump 33 and a mains power line 70 (FIG. 3) of a house to supply power to the dishwasher 10, typically by providing power via the controller 50. The terminal box 60 houses the coupling of a wire connection box 72 (FIG. 4) connected to the controller 50 or other electrical components and the mains power line 70.

Further, while the controller 50 has been illustrated in the door 18 it will be understood that the controller or an alternative controller can be disposed adjacent to the terminal box 60 such that the length of electrical connection extending between the terminal box 60 and the controller can be minimized.

Figure 2:
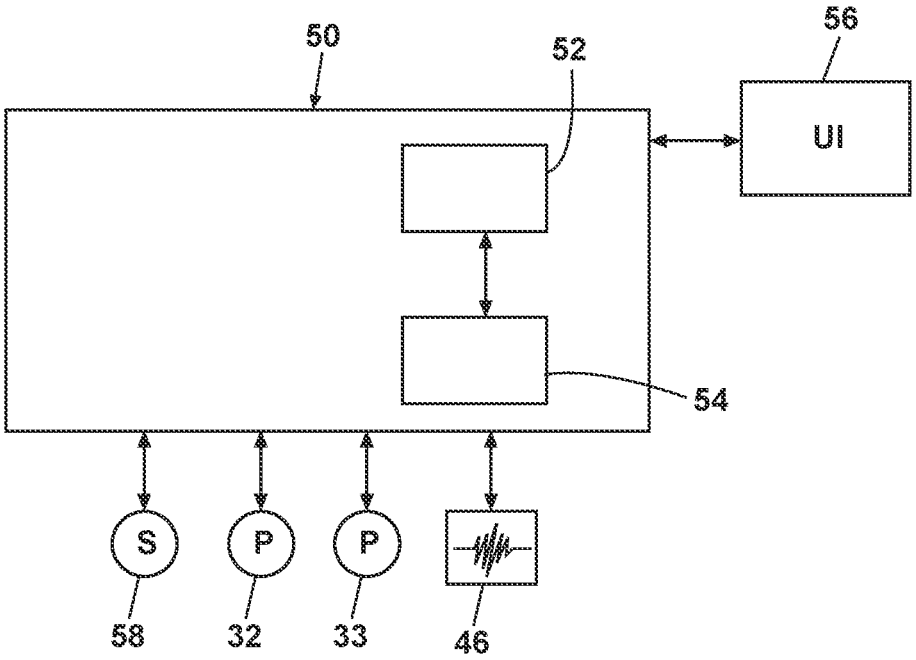
FIG. 2 is a schematic view of a controller of the dishwasher of FIG. 1.

As illustrated schematically in FIG. 2, the controller 50 can be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 can be provided with a memory 52 and a central processing unit (CPU) 54. The memory 52 can be used for storing control software that can be executed by the CPU 54 in completing a cycle of operation using the dishwasher 10 and any additional software. For example, the memory 52 can store one or more pre-programmed cycles of operation that can be selected by a user and completed by the dishwasher 10. The controller 50 can also receive input from one or more sensors 58. Non-limiting examples of sensors that can be communicably coupled with the controller 50 include a temperature sensor and turbidity sensor to determine the soil load associated with a selected grouping of dishes, such as the dishes associated with a particular area of the treating chamber.

Figure 3:
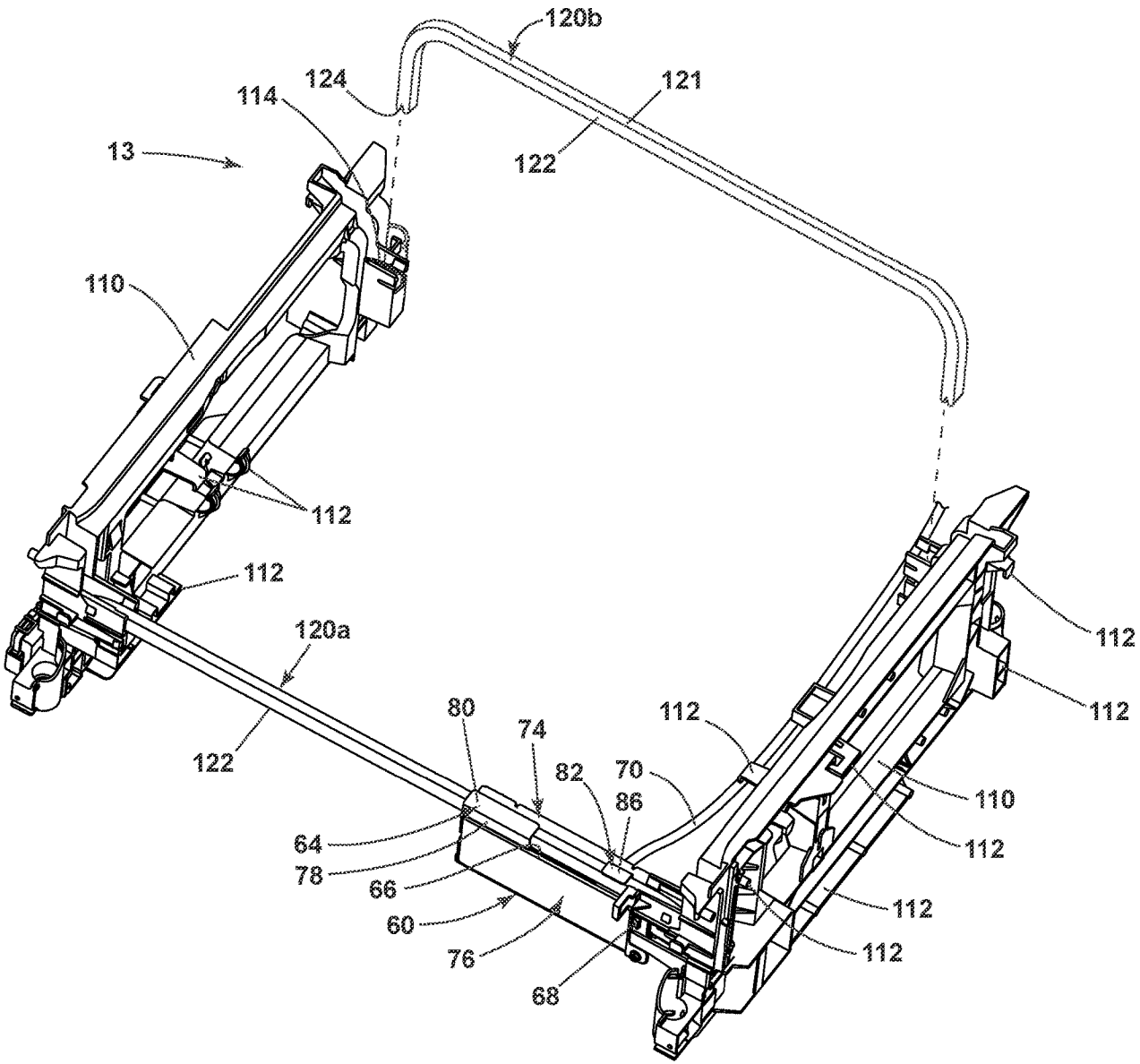
FIG. 3 is a perspective view of an exemplary portion of a chassis and terminal box of the dishwasher of FIG. 1

FIG. 3 illustrates a perspective view of the base 13 according to an exemplary aspect of the disclosure. The base 13 can include a set of spaced footings or panels 110 and a set of spaced beams or rails 120 connecting the set of panels 110. Multiple mounting bosses 112 can be included in the panels 110 and can serve to mount other parts of the dishwasher, such as hinges and brackets. It can be seen that the panels 110 can have a generally rectangular profile, or in other words, a rectilinear planform.

The base 13 can be a hybrid base structure formed from both plastic and metal. For example, the panels 110 can be plastic while the rails 120 can be metal. Therefore, the base 13 can be a combination of metal and plastic components. Furthermore, since the panels 110 can be made of injection molded plastic, the panels 110 can allow for greater versatility in the design, especially in terms of complex 3-D shapes, such as the location of mounting bosses 112 for snap-in features, or leveling assemblies 15, as compared to metal stampings.

In the illustrated example, each panel 110 includes leveling assemblies 15, which are mounted in a corner of the panel 110. It is contemplated that the leveling assemblies 15 can be mounted to the panel 110 in alternate locations and are not limited to corners. For example, it is possible for a leveling assembly 15 to be mounted to a middle of the panel 110. It is also possible for the panels 110 to not include leveling assemblies 15.

As better illustrated in FIG. 3, the pair of rails 120 can include a first rail 120*a* suspended between a first end of the two spaced panels 110. The second rail 120*b* can be suspended between a second end of the two spaced panels 110 but has been shown as being exploded therefrom for clarity. The rails 120 can be tubular with a hollow interior. The rails 120 have also been illustrated with a generally rectilinear cross-section, such that side-walls 121 of the rails 120 intersect and form generally right angles. It will be understood that this need not be the case and that the cross-section of the rails 120 can have a different geometry, such as a circular or triangular cross-section.

A middle portion 122 of the rails 120 connects terminal ends 124 of the rails 120. The terminal ends 124 connect to the panels 110 such that the rails 120 are generally parallel to each other, the panels 110 are generally parallel to each other, and the rails 120 and the panels 110 are generally perpendicular to each other.

The terminal ends 124 can be angled or bent relative to the middle portion 122 of the rails 120. Sockets 114 can be provided on the panels 110 that receive the terminal ends 124. The socket 114 can define a gap that is slightly smaller than the corresponding dimension of the terminal end 124, which provides for a press-fit of the terminal end 124 within the socket 114.

The rails 120 and panels 110 can take any suitable form and be operably coupled in any suitable manner including as disclosed in detail in U.S. Application Publication No. 2018/0192849, filed Jan. 6, 2017, which is incorporated herein by reference in its entirety. The terminal ends 124 can be retained within the sockets 114 by being press-fit into the sockets 114. Alternatively, the terminal ends 124 can be fastened to the sockets 114 by way of a fastener. The fastener can include a resilient finger (not shown), which can be provided on either one of the rail 120 or the panel 110. Such a resilient finger can be utilized to "lock" the terminal end 124 within the socket 114 in addition to or in lieu of the press-fit connection. The terminal end 124 of the rail 120 fits within the socket 114 of the panel 110. While the terminal end 124 is insert within the socket 114, the rail 120 can abut a stopping point (not shown) on the panel 110.

The terminal box 60 comprises a first portion 74 and a second portion or cover 76 that is selectively operably coupleable to the first portion 74 to define the interior 62 (FIG. 4). As can also be seen more clearly in FIG. 3, the first hook 64 extends from the upper section 66 of the terminal box 60. In the illustrated example, the first hook 64 includes an upwards extension 78 and a lateral extension 80 that are illustrated as hooking over the first rail 120*a*. A second hook 82 also extends from an upper section 66 of the terminal box 60 and is spaced from the first hook 64. The second hook 82 also includes an upwards extension 84 (FIG. 5) and a lateral extension 86. The second hook 2 is oriented such that the gap formed by the upwards extension 84 and the lateral extension 86 is opposite the gap formed by the first hook 64. In this manner, the first rail 120*a* may be received by and between both the first hook 64 and the second hook 82, which suspends the first portion 60 from the first rail 120*a* and vertically fixes the terminal box 60 in the space 17.

FIG. 4 more clearly illustrates the fastener 68, which is configured to operably couple the terminal box 60 to one of the two spaced panels 110 to laterally fix the terminal box 60. A projection 88 extends from the terminal box 60, more specifically the first portion 74, and includes an aperture 90. A resilient finger 92 with a catch 94 at its end is integrally formed with the spaced panel 110. The catch 94 is configured to be received within the aperture 90 and retain the projection 88 to lock the catch 94 within the projection 88. This laterally mounts the terminal box 60 to the panel 110.

FIG. 4 also shows a partially exploded view of the terminal box 60 and better illustrates that the first portion 74 correlates to a main section having a rear wall 96 and peripheral wall(s) 98 extending therefrom to define the interior 62. A first coupling tab 100 having a mounting aperture 102 extends from the peripheral wall 98. While the first coupling tab 100 is illustrated at a location on the first portion 74 near the projection 88 it will be understood that the first coupling tab 100 can be located in any suitable location. The first coupling tab 100 is disposed at the intersecting edge of front and side of the peripheral wall(s) 98. The first coupling tab 100 is parallel to the rear wall 96.

Figure 5:
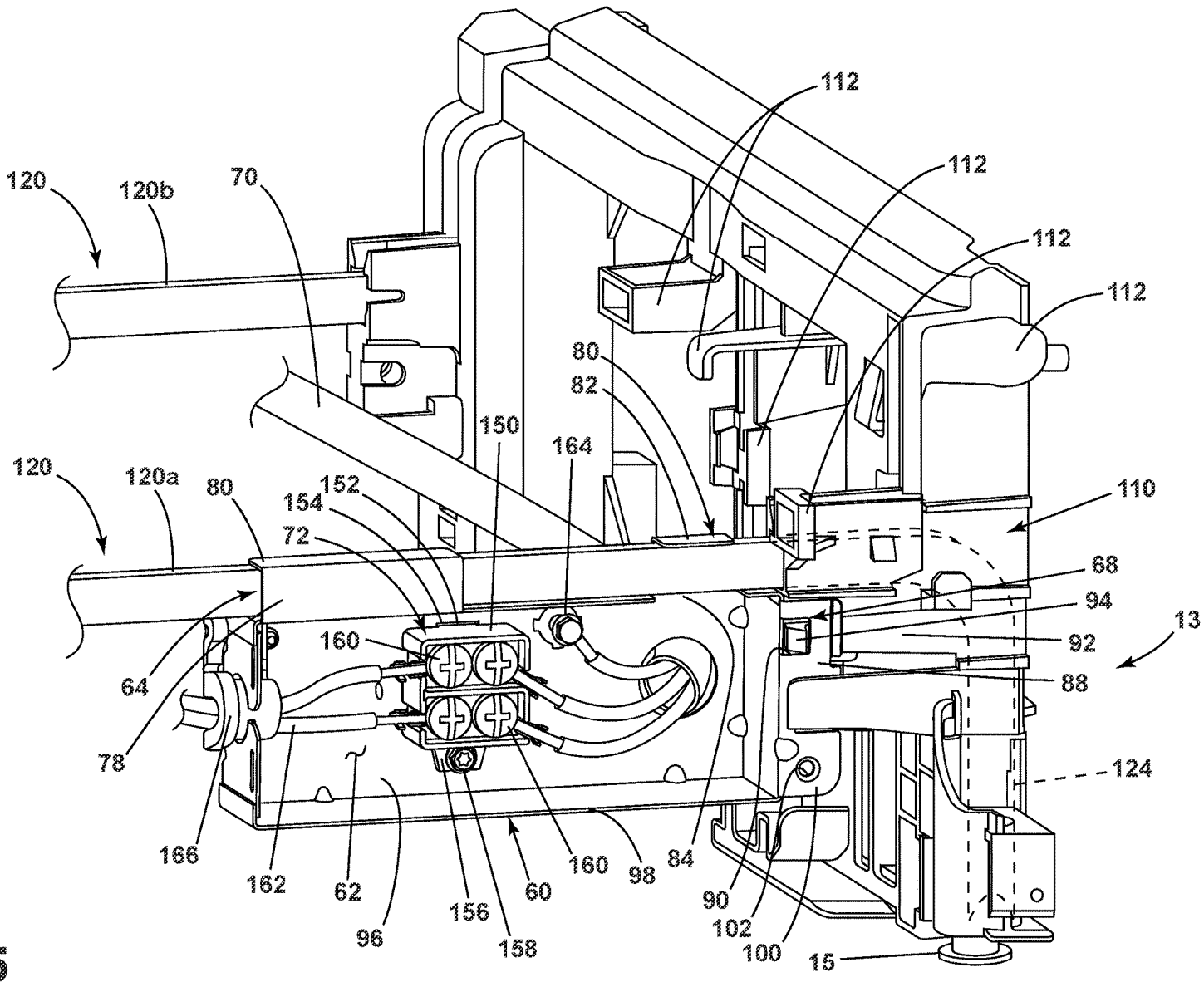
FIG. 5 is a front view of a portion of the chassis of FIG. 3 and the terminal box with the cover removed and showing exemplary wiring that can be included in the dishwasher of FIG. 1.

The rear wall 96 includes an input aperture 106 configured to receive a mains power line 70 (FIG. 5). The side peripheral wall 104 can include upper cover retaining slots 108 and an output opening 130 configured to receive a dishwasher electrical connection.

The cover 76 is in the form of a cover configured to engage the first portion 74 to enclose interior 62 including a second coupling tab 132 having a mounting aperture 134. The cover 76 further comprises an upper surface 138 connected to a downwardly extending side wall(s) 140 that can be a unitary side wall or separate side walls. Upper retaining tabs 142 extend from rear portion of one of the side walls 140. The upper retaining tabs 142 are configured to be received by the upper cover retaining slots 108 in the first portion 74.

As further illustrated in FIG. 5, a terminal block or wire connection box 72 is also located on the rear wall 96. The wire connection box 72 includes a housing 150 that can be mounted to the rear wall 96 in any suitable manner. In the illustrated example, the housing 150 includes a first extension 152 having a catch or hook portion (not shown) that is snapped into an aperture 154 in the rear wall 96 and a second projection 156 that is mounted to the rear wall 96 utilizing a fastener 158. It will be understood that the housing 150 may be mounted to the rear wall 96 only via snapping, only via fasteners, or through any other suitable manner. The fastener 158 can be of any type capable of selectively mounting the terminal box 60 to the rear wall 96. Examples of suitable fasteners can include but are not limited to screws, press-fit or snap-fit fasteners, spring clips, and nuts and bolts. The housing 150 can include any suitable housing including a non-conductive housing such a plastic housing, by way of non-limiting example.

The housing 150 extends away from the rear wall 96 and is configured to keep electrical connections from contacting the terminal box 60. The housing 150 is substantially centrally located within the first portion 74. Location of the input aperture 106, output opening 130, and the housing 150 all aids in limiting contact of electrical connections with the terminal box 60.

A set of screws 160 are located within the compartment defined by the housing. The screws 160 are configured to attach both the dishwasher electrical connections 162 and the connections from the mains power line 70. When the electrical connections are attached to the screws 160, the housing 150 holds the electrical connections in place and away from the terminal box 60.

Further, the rear wall 96 can include a grounding fastener 164 to secure a grounding wire from the mains power line 70. A rear side of the rear wall 96 can include a second grounding fastener (not shown) from the outside to secure a grounding wire from the dishwasher 10. A retainer 166 can be mounted within the output opening 130 and is configured to hold dishwasher electrical connections 162, including from a bundle of wires or wire harness inside the dishwasher 10. The retainer 166 further locates the dishwasher electrical connections 162 away from the walls of the terminal box 60 and stabilizes them.

The terminal box 60 can be manufactured from a variety of materials and a variety of processes. For example, the terminal box 60 can be manufactured from galvanized steel using stamping and bending processes. Other materials can include but are not limited to plastics, composites and alloys and other processes can include but are not limited to injection molding, welding, casting, and cutting.

In operation, the cover 76 is separated from the first portion 74 so as to expose the interior 62. The mains power line 70 can enter the interior 62 through the input aperture 106. A dishwasher electrical connection can enter the interior compartment 62 through the output aperture 130. The mains power line 70 can be electrically coupled to a dishwasher electrical connection in the interior compartment 62. More specifically, both the positive and negative electrical connections for the mains power line 70 and the dishwasher electrical connections 162 can be fastened via the screws 160 to the wire connection box 72. Once the mains power line 70 is electrically coupled to the dishwasher electrical connections 162, the cover 76 is placed on the first portion 74 so as to enclose the interior compartment 62.

To engage the cover 76 with the first portion 74, the upper retaining tabs 142 are inserted into the upper cover retaining slots 108. The cover 76 is then moved rearwardly until the upper surface 138 and side wall 140 abut the peripheral wall 98. The mounting apertures 102, 134 coaxially align when the cover 76 engages the first portion 74 to receive a fastener 136 to commonly mount the cover 76 and the first portion 74 of the terminal box 60 together. In this manner, the user can engage the cover 76 and first portion 74 prior to positioning and securing the terminal box 60, which minimizes the amount of work a user performs in the space beneath the tub 14 when installing the terminal box 60.

To mount the terminal box 60 to the chassis 12, the first hook 64 and the second hook 82 are placed about the rail 120. Then the terminal box 60 is located such that the projection 88 retains the catch 94. This can be accomplished by moving the finger 92 or forcing the terminal box 60 into place.

To open the terminal box 60, the fastener 136 is removed from the terminal box 60 and the upper retaining tabs 142 are disengaged from the slots 108. The cover 76 can be separated from the first portion 74 to allow easy access to the interior compartment of the terminal box 60 containing the coupled mains power line and dishwasher electrical connection.

By removably mounting the first portion 74 and cover 76 to the chassis 12, the terminal box 60 can be removed from the space beneath the tub 14 to provide access to components of the dishwasher located behind the terminal box 60. To remove the terminal box 60, the user depresses the finger 92 inwardly to clear the catch 94 from the projection 88 and pulls the terminal box away from the panel 110. Then, at least one of the first hook 64 or the second hook 82 can be displaced outwardly to remove the terminal box from the rail 120.

The aspects of the disclosure described herein include a terminal box that that can be mounted vertically from a rail of a chassis of the dishwasher in a space below the tub and above the ground and in a spaced relationship above the drip tray 19 within the dishwasher. The terminal box can be laterally mounted to a panel of the chassis via a resilient finger clip that is easy to engage and disengage. Both means of mounting are simple and lead to intuitive installation and removal. The terminal box can be removed from the space beneath the tub to provide more working space for a user when working on the electrical connections within the terminal box. Furthermore, the ability to easily remove the terminal box from the space beneath the tub provides access to dishwasher components located behind the terminal box, thereby increasing serviceability of the dishwasher.

Further still, utilization of a wiring block or connector box within the terminal box aids in retaining electrical connections and maintaining them away from walls of the terminal box. In contemporary appliances wiring can be bent in many different orientations allowing wires and wire nut connections to be placed anywhere inside terminal boxes, in such an instance where there is a failure condition wires could be pushed against the walls of the terminal box causing damage. Aspects of the present disclosure utilize a wire connection box having a housing that provides a centrally located wire connection that will ensure the wires cannot come in contact with the wall of the terminal box enclosure.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to at least one automatic cycle of operation, the dishwasher comprising:

a tub at least partially defining a treating chamber;

a chassis supporting the tub and defining a space below the tub;

a terminal box located within the space and having at least one enclosure wall defining an interior; and a wire connection box located within the interior wherein the wire connection box includes a housing and multiple terminals inset within the housing and wherein the wire connection box is configured to receive an electrical connection for the dishwasher coupled to an electrical mains power line and wherein the housing is configured to keep wires from contacting the at least one enclosure wall of the terminal box.

2. The dishwasher of claim 1 wherein the terminal box includes a first portion with a rear wall and a peripheral wall extending from the rear wall and defining an enclosure with an open face and a second portion defining a cover for the open face.

3. The dishwasher of claim 2, further comprising a selectively removable fastener operably coupling the first portion and the second portion.

4. The dishwasher of claim 2 wherein the rear wall comprises an opening offset from the wire connection box and the opening is configured to receive the electrical mains power line, which extends from a rear of the dishwasher.

5. The dishwasher of claim 4 wherein the chassis includes a base supporting the tub, the base having a set of spaced panels and a set of spaced beams, each panel having multiple sockets, each beam having opposed terminal ends, wherein, for each of the beams, one of the terminal ends is received within one of the sockets for one of the panels and the other of the terminal ends is received within one of the sockets for the other of the panels to fasten the set of spaced beams to the set of spaced panels and form a rectilinear planform.

6. The dishwasher of claim 4 wherein the peripheral wall of the terminal box includes a second opening and the second opening is configured to receive additional wires connected to the wire connection box.

7. The dishwasher of claim 2 wherein the wire connection box is snapped into a rear aperture in the rear wall of the terminal box via at least one housing mounting tab having a hook portion.

8. A dishwasher for treating dishes according to at least one automatic cycle of operation, the dishwasher comprising:

a tub at least partially defining a treating chamber;

a chassis supporting the tub and defining a space underneath the tub;

a terminal box located within the space and having a rear wall and an enclosure wall extending from the rear wall, together defining an interior, wherein the rear wall comprises a first opening configured to receive an electrical mains power line and wherein the enclosure wall comprises a second opening configured to receive a dishwasher electrical connection; and a wire connection box fastened to the rear wall of the terminal box and having a housing with multiple terminals electrically coupling the electrical mains power line and the dishwasher electrical connection, wherein the housing isolates the electrical mains power line and the dishwasher electrical connection from the rear wall and the enclosure wall of the terminal box.

9. The dishwasher of claim 8, wherein the terminal box includes a first portion with a rear wall and a peripheral wall extending from the rear wall and defining an enclosure with an open face and a second portion defining a cover for the open face.

10. The dishwasher of claim 9 wherein the terminal box further comprises a second portion defining a cover for the open face that selectively operably couples to the first portion via a selectively removable fastener.

11. The dishwasher of claim 8 wherein the chassis includes a base supporting the tub, and wherein the terminal box is removably secured to the base by a fastener.

12. The dishwasher of claim 11 wherein the fastener includes a mounting aperture on one of the base or the terminal box and a mounting hook on the other of the base or the terminal box and wherein the mounting hook operably couples the mounting aperture to mount the terminal box to the base.

13. The dishwasher of claim 8, wherein the second opening is configured to receive a retainer, and wherein the retainer is configured to hold the dishwasher electrical connection away from the walls of the terminal box.

14. The dishwasher of claim 9, wherein the first opening and second opening are offset from the wire connection box and wherein the wire connection box is substantially centrally located within the first portion.

15. The dishwasher of claim 8 wherein the housing comprises a non-conductive material.

16. The dishwasher of claim 8, further comprising multiple screw fasteners located within the housing and configured to connect with terminal ends of the electrical mains power line and terminal ends of the dishwasher electrical connection.

17. The dishwasher of claim 11, wherein the terminal box includes a projection with an aperture and wherein the base includes a resilient finger with a catch, and wherein the catch is configured to be received within the aperture to lock the catch within the projection.

18. The dishwasher of claim 8, further comprising a drip tray located in the space and wherein the terminal box is located in a spaced relationship above the drip tray.

19. The dishwasher of claim 8, wherein the dishwasher comprises a controller, wherein the controller is located adjacent the terminal box.

20. The dishwasher of claim 8, wherein the wire connection box includes a divider between the multiple terminals.

* * * * *